United States Patent [19]

Ogihara et al.

[11] 4,023,738

[45] May 17, 1977

[54] APPARATUS FOR PRODUCING FINE IRON PARTICLES

[75] Inventors: Susumu Ogihara; Yoshitomo Tezuka, both of Hachiohji, Japan

[73] Assignee: Aida Engineering, Ltd., Japan

[22] Filed: Jan. 22, 1976

[21] Appl. No.: 651,349

[30] Foreign Application Priority Data

Feb. 6, 1975 Japan ..... 50-14903

[52] U.S. Cl. ..... 241/271; 241/223

[51] Int. Cl.[2] ..... B02C 1/14

[58] Field of Search ..... 241/27, 30, 172, 221, 241/223, 270, 271

[56] References Cited

UNITED STATES PATENTS

| | | | |
|---|---|---|---|
| 1,170,888 | 2/1916 | Fuchs | 241/271 |
| 1,424,697 | 8/1922 | Warren | 241/271 |
| 2,059,229 | 11/1936 | Gregg | 241/27 |
| 2,175,321 | 10/1939 | Saffir | 241/172 |
| 2,350,534 | 6/1944 | Rosinger | 241/172 |

*Primary Examiner*—Granville Y. Custer, Jr.

[57] ABSTRACT

An apparatus for carrying out the process of producing fine iron particles which comprises in combination an endless chain trained about a pair of opposite and spaced drive and driven sprockets and having a plurality of spaced permanent magnets attached to the exposed side of the chain, a non-magnetic chip guide plate positioned above and in parallel to the chain and having a hopper at one end and a chip discharge chute at the other end and a magnetic striking member normally disposed above and spaced from said chip guide plate and connected to a reciprocal impact means to be moved toward and away from said guide plate as the impact means moves reciprocally.

6 Claims, 8 Drawing Figures

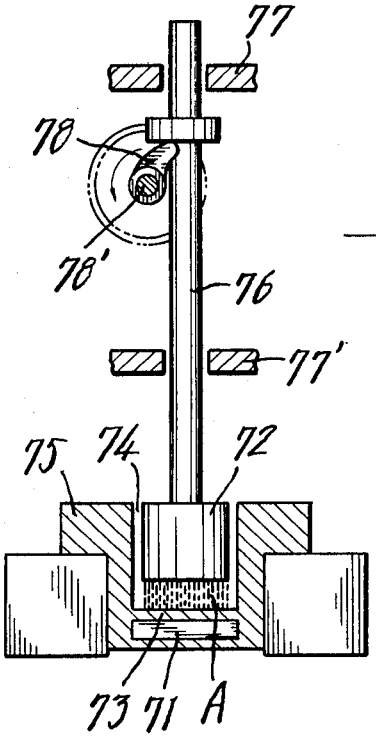
Fig. 7.
Fig. 8.
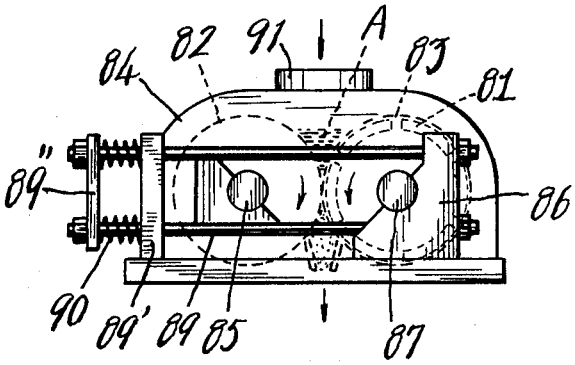

APPARATUS FOR PRODUCING FINE IRON PARTICLES

BACKGROUND OF THE INVENTION

This invention relates to apparatus for producing fine particles from cutting chips such as iron chips and the like.

Metal particle molding art has made a remarkable development in various fields of industry and especially, in the field of iron machine parts in the past several years, but such an art has the disadvantages that the production cost of iron particles is relatively higher and the supply source of such particles is relatively scarce as compared with those for molten molding materials. Thus, the metal particle molding art is at present suffering from chronic shortage of iron particle supply. Of late, a novel art has been developed by which materials such as cutting chips which are easily subject to oxidation and coarse iron particles can be molded without difficulty rather than the employment of high quality iron chips. The present invention is to solve the problems relating to the cost to be incurred in the crushing of cutting chips to finer particles and shortage of supply source materials in the employment of the newly developed molding art.

Conventional crushers useful in the crushing of metal materials to finer particles are represented by stamp mills, ball mills and rod mills. However, when flat materials such as cutting chips have flat configurations and tacky materials are stacked in layers and crushed to finer particles by delivering a striking force from above, any of the conventional crushers encounters difficulty, requires a relatively long time and yields desired fine particles at a relatively low ratio. Furthermore, when cutting chips are crushed by the conventional crushers, the resulting fine particles tend to round because the particles have been subjected to the crushing force for a rather long time and such rounded fine particles have poor molding characteristics. Therefore, the fine particles produced by the conventional crushers have been scarely employed for practical purposes.

SUMMARY OF THE INVENTION

Therefore, one object of the present invention is to provide an apparatus for crushing iron chips to finer particles which can effectively eliminate the disadvantages inherent in the prior cutting chip crushing arts referred to hereinabove and which can effectively crush such cutting chips to finer particles.

According to the present invention, cutting chips such as iron chips are placed in the magnetic field formed between a first block comprising a permanent magnet and an opposite second block comprising an iron or the like magnetic member or a pemanent magnet having the polarity opposite to that of the first block and the opposite surfaces of the two blocks are relatively and repeatedly moved toward and away from each other in the direction of lines of magnetic force to cause the cutting chips to yield down and to be crushed to finer particles. Alternatively, an additional block comprising a non-magnetic member is interposed between the first magnet block and second magnetic blcok (or magnet having the polarity opposite to that of the first block) and cutting chips are then placed between the first or second blocks and additional block to be caused to yield down and be crushed by the relative and repeated movement of the first and second blocks toward and away from each other.

The above and other objects and attendant advantages of the present invention will be more readily apparent to those skilled in the art from a reading of the following detailed description in conjunction with the accompanying drawings which illustrate preferred embodiments of the invention for illustration purpose only, but not for limiting the scope of the same in any way.

BRIEF DESCRIPTION OF THE DRAWINGS

FIG. 7 is a fragmentary elevational view of a third embodiment of apparatus for carrying out the process of the present invention;

FIG. 8 is a fragmentary view of a fourth embodiment of apparatus for carrying out the process of the present invention.

PREFERRED EMBODIMENTS OF THE INVENTION

Figure 1:
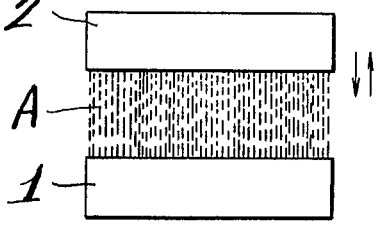
FIGS. 1, 2 and 3 are schematic views showing the principle of the present invention.
Figure 2:
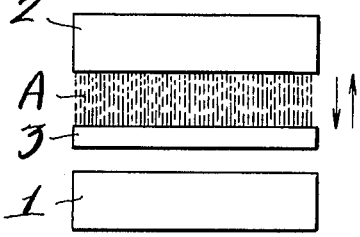
Figure 3:
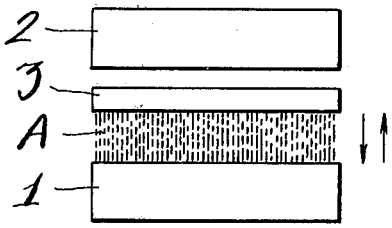

Referrring now to the various figures of the accompanying drawings in which corresponding reference characters indicate corresponding parts throughout the various views of the drawings and more particularly, to FIG. 1 thereof in which the prinicple of the present invention is shown. As shown, it is appreciated that when a batch of small iron chips A are placed into between a lower permanent magnet 1 and a magnetic member 2 (or a permanent magnet having the polarity opposite to that of the magnet 1) which is disposed right above and normally spaced from the magnet 1, the individual iron chips erect themselves like ice needles in the direction of lines of magnetic force of the magnetic field formed between the permanent magnet 1 and magnetic member 2 (or opposite polarity magnet). When one of the magnet 1 and magnetic member 2 is moved toward and away from the other or both the two members are relatively and repeatedly moved toward and away from each other in the arrow directions while maintaining the iron chips in their ice needle condition, the batch A of iron chips are effectively compressed, caused to yield down and finally be crushed to finer particles. Alternatively, even when a non-magnetic block 3 is interposed between the permanent magnet 1 and magnetic member 2 (or opposite polarity magnet) in a position adjacent to the magnet 1 or magnetic member 2 as seen in FIGS. 2 and 3, the same effective crushing effect can be obtained.

Furthermore, in order to further enhance the crushing efficiency, prior to the proper crushing operation by the magnet 1 and magnetic member 2, the batch A of iron chips may be preliminarily rolled by means of rolling rollers and especially, when the iron chips comprise long curled chips such as lathe chips, the chips may be preliminarily ground to coarse particles. Altenatively, when the material to be crushed is of tacky one, prior to proper crushing operation as mentioned hereinabove, such a tacky material may be previously cooled to further enhance the crushing efficiency.

Figure 4:
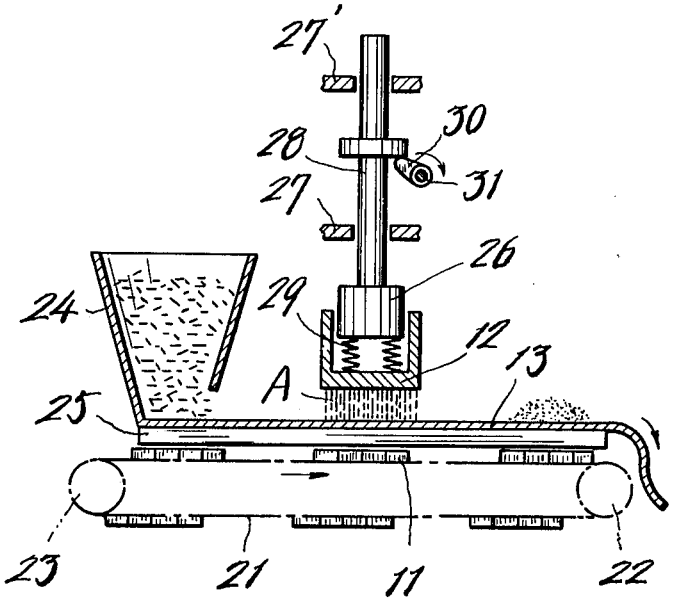
FIG. 4 is a side elevational view of a first embodiment of apparatus of the present invention, certain parts being shown as broken away or in section for the sake of clarity.

FIG. 4 shows the first embodiment of apparatus which can be suitably employed in carrying out the process of the present invention. In this figure, reference character 21 denotes an endless chain which is trained about a drive sprocket 22 and a follower or driven sprocket 23. A plurality of permanent magnets 11 are attached to the exposed side of the endless chain in a suitably spaced relationship. A chip guide or carrier plate 13 is suitably provided above and in parallel to the upper run of the endless chain 21 and formed of a non-magnetic stainless steel plate. One end or the left end of the chip guide plate 13 is integrally formed with a frusto-conical hopper 24 which extends uprightly from the guide plate and has an opening in the side wall adjacent to the bottom of the hopper through which iron chips are to be discharged in batch onto the guide plate 13 and the other or right end of the guide plate 13 is curved downwardly to form a chute along which the product or crushed particles are discharged from the system into a suitable receptacle (not shown) for practical purpose or re-processing. A reinforcing plate 25 comprising a non-magnetic material is provided along and in contact with the underside of the guide plate 13. Reference character 26 denotes an impact block 26 secured to the lower end of a shaft or rod 28 which is vertically movable and in turn supported in lower and upper spaced bearings 27, 27′ suitably supported in the machine framework(not shown). A striking plate 12 comprising a non-magnetic material is connected to the underside of the impact block 26 with springs 29 interposed therebetween and the underside of the striking plate 12 faces the upper side of the non-magnetic chip guide plate 13. The underside of the striking plate 12 is normally held in a spaced relationship to the upper side of the chip guide plate 13. Reference character 30 denotes a cam which is secured to a transverse rotary shaft 31 which is in turn suitably journalled in the machine framework (not shown) and the cam is adapted to rotate as the shaft 31 rotates to engage and disengage from the flange on the rod 28 which in turn allows the rod 28 and accordingly, the block 26 attached to the rod to reciprocally move vertically.

In operation, the endless chain 21 is continuously driven in the arrow direction as seen in FIG. 4 and when the plural magnets 11 on the upper run of the chain 21 are in succession positioned below the bottom of the hopper 24 as the chain moves continuously. Successive batches A of the iron chips are discharged from the hopper 24 through the discharge opening onto the guide plate 13 which are then moved along the guide plate 13 under the action of the particular moving magnets 11 to the position right below the magnetic striking plate 12 whereupon the iron chips erect themselves in the direction of lines of magnetic force of the magnetic field formed between the magnet 11 and magnetic striking plate 12 and at the same time, the rod and impact block assembly 28, 26 is allowed to drop by the disengamenent of the rotating cam 30 from the flange on the rod 28 to cause the striking plate 12 to strike against the now erecting iron chips A to cause the chips to yield and be crushed to finer particles. The thus produced fine particles are moved along the guide plate 13 by the magnetic force of the moving magnets 11 to the discharge end of the guide plate from where the particles are discharged into the receptacle. If and when the iron chips have not been fully crushed to particles having a desired particle size, the insufficiently crushed particles are recycled to the hopper 24 for further processing.

Figure 5:
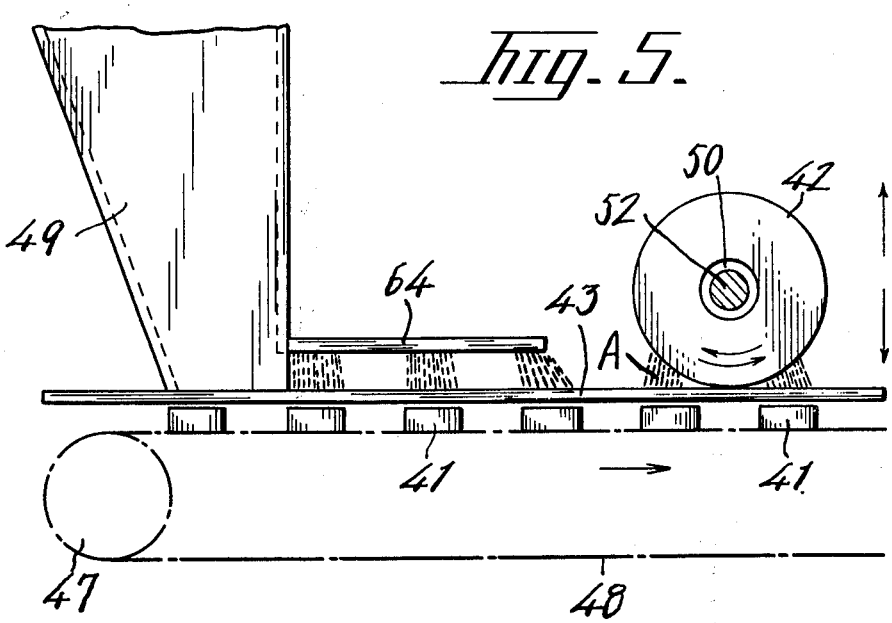
FIG. 5 is a schematic side elevational view of a second embodiment of apparatus of the present invention, certain parts being shown as broken away for the sake of clarity.
Figure 6:
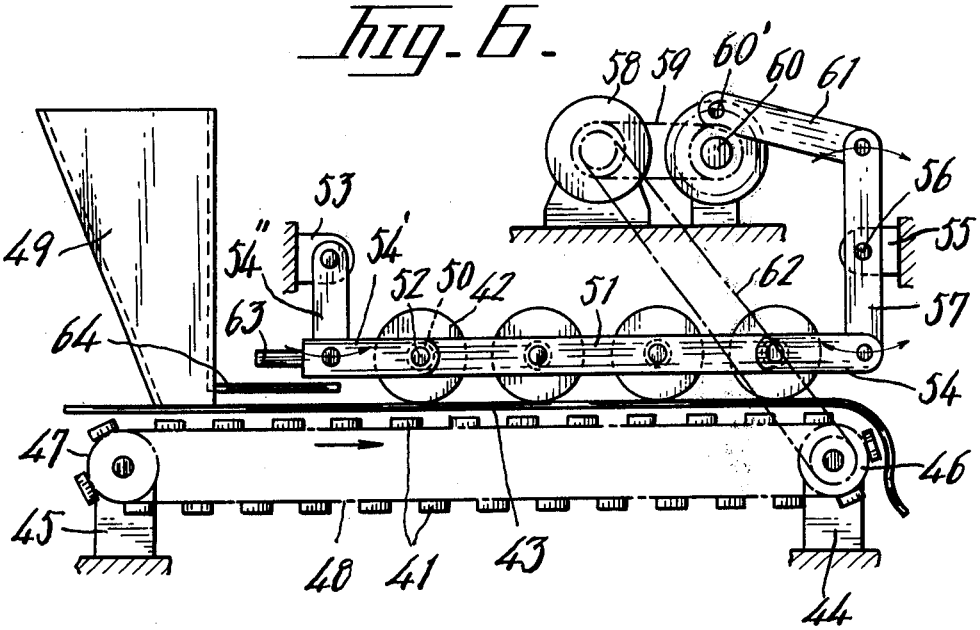
FIG. 6 is a side elevational view of the apparatus as shown in FIG. 5 showing additional part which are not shown in FIG. 5, certain parts being shown as broken away.

FIG. 5 schematically shows the second embodiment of apparatus of the invention in which magnetic rollers 42 (only one roller 42 is shown in FIG. 5) are employed as the iron chip crushing means in place of the magnetic striking plate 12 and impact block 26 as employed in the first embodiment of apparatus referred to hereinabove and the rollers 42 are adapted to rotate about their axes and also moe vertically. FIG. 6 shows the detail of the embodiment of FIG. 5 together with additional parts including means for driving the magnetic rollers 42.

The embodiment of FIG. 6 represents a modification of the embodiment of FIG. 4. An endless chain 48 is trained about a drive sprocket 46 and a follower of driven sprocket 47 which are journalled in stationary brackets 44, 45, respectively and a plurality of suitably spaced permanent magnets 41 are attached to the exposed side of the chain. An iron chip guide plate 43 formed of a non-magnetic stainless steel plate is provided above and in parallel to the upper run of the chain 48 and formed at one or the left end as seen in FIG. 6 with a hopper 49 in which iron chips are received. The other or right end of the guide plate 43 is curved downwardly to form a chute so that the formed fine particles are discharged along the curved end or chute into the receptacle (not shown) for practical purpose or re-processing. The hopper 49 has an opening in the side wall in a position adjacent to the bottom of the hopper through which the iron chips are discharged in batch from the hopper onto the guide plate 43 and a magnetic iron chip guide 64 extends from the upper edge of the discharge opening to a distance over the guide plate 43 and is spaced from the latter to guide a batch of iron chips in cooperation with the guide plate 43. A striker assembly is suitably disposed above and in parallel to the guide plate 43 and comprises a horizontal connector bar 51 provided with a plurality of equally spaced shafts 52 in a line along the length of the bar and a plurality of magnetic rollers 42 having their center holes 50 which have a diameter larger than that of the shaft 52 so that the rollers can rotate and also move vertically with respect to the connector bar. One or the left end of the connector 51 is connected through links 54′, 54″ to a stationary bracket 53 which is in turn secured to the machine framework (not shown) and the other end or right end of the connector bar 51 is connected through a link 54 to and supported by the lower end of a lever 57 which is pivoted in an intermediate position between the lower and upper ends thereof by means of a pin 56 suitably supported in a stationary bracket 55 which is in turn secured to the machine framework (not shown). The upper end of the lever 57 is connected by link 61 to the crank pin 60′ on a crank shaft 60 which is driven from a motor 58 suitably supported on the machine framework (not shown) through a belt 59 trained about the crank shaft and the output shaft of the motor. The motor 58 also drives the drive sprocket 46 through a belt 62 trained about the output shaft of the motor and the sprocket 46. Reference character 63 denotes an striking bar secured to the link 54′ for delivering a striking force to the hopper 49 to accelerate the discharge of iron chips from the hopper.

In operation, the endless chain 48 is continuously driven and when the plural magnets 41 on the upper run of the chain are in succession positioned below the bottom of the hopper 49, successive batches of iron chips are discharged from the hopper 49 through the discharge opening onto the guide plate 43 and then moved along the guide plate while passing in succession below the successive rollers 42 by the action of the successive moving magnets 41. When successive batches of iron chips are in succession positioned below the successive rollers 42 as the batches are moved along the guide plate 43, the lever 57 is reciprocally rocked about the pin 56 to reciprocally move the connector bar 51. The reciprocal movement of the connector bar 51 in turn causes the rollers 42 to move reciprocally and vertically by virtue of presence of the clearnces between the holes 50 in the magnetic rollers 42 and associated shafts 52 in the connector bar 51 whereby the iron chips erecting in the direction of lines of magnetic force of the magnetic field formed between the successive magnets 41 and magnetic rollers 42 are caused to yield down and be crushed to fine particles. The thus obtained fine particles are carried along the guide plate 43 to the discharge end of the plate by the magnetic action of the moving magnets 41 from where the fine particles are discharged into the receptacle (not shown) for practical purpose or re-processing.

FIG. 2 fragmentarily shows the embodiment of a stamp mill type apparatus of the present invention and in this embodiment, a block 75 formed of a non-magnetic material is provided with a recess 74 for receiving iron chips therein and a permanent magnet 71 is embedded in the block 75 below the bottom 73 of the recess 74. A striking body 72 formed of a magnetic material is normally positioned above the bottom 73 of the recess 74 and attached to the lower end of a vertically movable rod 76 which is in turn suitably supported in upper and lower bearings 77, 77' suitably supported in the machine framework (not shown). A cam 78 is secured to a transverse rotating shaft 78' for engaging and disengaging from the flange on the rod 76 to vertically and reciprocally move the rod 76 and accordingly, the magnetic striking member 72 secured to the rod whereby the iron chips erecting in the direction of lines of magnetic force of the magnetic field formed between the magnetic striking member 72 and permanent magnet 71 are caused to yield down and be crushed to finer particles when the magnetic striking member 74 with the iron chips interposed therebetween.

FIG. 8 shows the fourth embodiment of apparatus of the present invention. In this embodiment, a roller 82 formed of a magnetic material is secured to a horizontal shaft 85 which is in turn suitably supported in a stationary machine framework 84 and which is suitably rotated by a conventional drive mechanism (not shown). A second roller 83 formed of non-magnetic material is secured to a horizontal shaft 87 which extends in parallel to the shaft 85 and is in turn suitably journalled in a horizontally movable machine framework 86 which is slidable on the base. The roller 83 is provided in its periphery with a plurality of circumferentially spaced permanent magnets 81. A pair of upper and lower parallel connector rods 89 extend at one end or the right end through and secured to the movable framework 86 and the other or left ends of the rods 89 extend loosely through a bracket 89' extending uprightly from the base and facing the movable framework 86. The extreme left ends of the parallel connector rods 89 have an anchor plate 89'' fixedly secured thereto and coiled springs 90 are disposed about the rods 89 between the bracket 89' and anchor plate 89'' with the opposite ends of the springs anchored to the bracket and anchor plate to normally urge the movable framework 86 and accordingly, the roller 83 toward the roller 82 to define a nip between the outer peripheries of the rollers 82, 83. In operation, iron chips are supplied through an inlet 91 formed in the machine framework in the position just above the nip between the rollers into the nip whereupon the supplied iron chips are caused to be oriented in the direction of lines of magnetic force of the magnetic field formed between the magnets 81 and roller 82 and the movable roller 83 is repeatedly and reciprocally moved toward and away from the roller 82 by a suitable mechanism (not shown) to cause the iron chips to yield and be crushed to finer particles.

As clear from the foregoing description of preferred embodiments of the present invention, since iron chips are caused to yield down and be crushed to finer particles while they are held in the erected position within the magnetic field formed between the opposite porality magnetic members, the crushing operation can be efficiently carried out whereby finely divided iron particles which are easily shaped can be obtained and productivity of fine particles can be improved.

While several specific embodiments of the invention have been shown and described in detail, it will be understood that the same are for illustration purpose only and not to be taken as a definition of the invention, reference being had for the purpose to the appended claims.

What is claimed is:

1. An apparatus for producing fine iron particles comprising a member formed of at least one permanent magnet; another member formed of a magnetic material; said two members having mutually facing relationship to provide a magnetic field therebetween; a driving means operatively associated with said members for relatively moving them repeatedly toward and away from each other for crushing iron chips; and guide means for introducing iron chips between the two members.

2. The apparatus as claimed in claim 1, wherein said guide means is a guide plate formed of a non-magnetic material along which iron chips are guided in a horizontal direction; the permanent magnet member comprises a plurality of magnets attached to an endless chain positioned below said guide plate for moving said iron chips along the guide plate; and the magnetic member is a striking member which is reciprocally movable toward and away from the upper surface of said guide plate by said drive means to cause said iron chips to be crushed into finer particles.

3. The apparatus as claimed in claim 1, wherein said guide means is a guide plate formed of a non-magnetic material along which iron chips are guided in a horizontal direction; the permanent magnet member comprises a plurality of magnets attached to an endless chain positioned below said guide plate for movement along the guide plate; and the magnetic member being a roller disposed above said guide plate for causing said iron chips to be crushed into finer size.

4. The apparatus as claimed in claim 1, wherein said guide means is a stationary member formed of a non-magnetic material having a recess for receiving the iron chips therein the permanent magnet is embedded in said stationary member below the bottom of said recess; and the magnetic member is a striking member reciprocally movable toward and away from said recess by said drive means to cause said iron chips to be crushed into finer particles.

5. The apparatus as claimed in claim 1, wherein the magnetic member is a continuously rotatable roller; the guide means is a roller formed of a non-magnetic material disposed in parallel to said first-mentioned roller for peripheral contact with the firstmentioned roller; and the permanent magnet is a plurality of magnets attached to the outer periphery of said guide means.

6. The apparatus as claimed in claim 1, wherein said permanent magnet is a plurality of spaced permanent magnets on the exposed surface of an endless chain trained about a pair of drive and driven sprockets; the guide means is a non-magnetic guide plate positioned above and in parallel relationship to said endless chain and having chip receiving means at one end and chip discharge means at the other end; the magnetic member is a plurality of rollers normally spaced above the upper surface of said guide plate to provide a magnetic field in cooperation with said permanent magnets and reciprocally movable toward and away from said guide plate.

* * * * *